US005356326A

United States Patent [19]

Ting

[11] Patent Number: 5,356,326

[45] Date of Patent: Oct. 18, 1994

[54] SHAKING TOY

[75] Inventor: Charles Ting, Taipei, Taiwan

[73] Assignee: T. L. Products' Promoting Co., Ltd. A Corporation of Taiwan, Taipei, Taiwan

[21] Appl. No.: 890,611

[22] Filed: May 28, 1992

[51] Int. Cl.[5] ..... A63H 11/02; A63H 3/28

[52] U.S. Cl. ..... 446/175; 446/298; 446/353; 446/322

[58] Field of Search ..... 446/353, 352, 354, 356, 446/175, 297, 236, 273, 274, 303, 298, 325, 326, 396, 359, 361, 322, 323, 234, 233; 40/414

[56] References Cited

U.S. PATENT DOCUMENTS

| | | | |
|---|---|---|---|
| 546,021 | 9/1895 | Luckenbach . | |
| 2,148,010 | 2/1939 | Bowers . | |
| 2,288,371 | 6/1942 | Rothschild | 446/354 |
| 2,504,652 | 4/1950 | Cohn | 446/325 X |
| 2,763,959 | 9/1956 | Glass et al. . | |
| 3,029,552 | 4/1962 | Katz | 446/353 |
| 3,514,899 | 6/1970 | Bonanno et al. . | |
| 4,536,167 | 8/1985 | Hughes | 446/325 X |
| 4,571,208 | 2/1986 | Saigo et al. | 446/353 |
| 4,775,351 | 10/1988 | Provenzano, Jr. | 446/175 |
| 4,867,726 | 9/1989 | Fujimaki | 446/175 |
| 4,878,871 | 11/1989 | Noto | 446/302 |
| 4,941,857 | 7/1990 | Fujimaki | 446/353 |

FOREIGN PATENT DOCUMENTS

| | | | |
|---|---|---|---|
| 377592 | 7/1932 | United Kingdom | 446/354 |
| 2119264 | 11/1983 | United Kingdom | 446/326 |
| 2186200 | 8/1987 | United Kingdom | 446/354 |

*Primary Examiner*—Mickey Yu

*Attorney, Agent, or Firm*—Cohen, Pontani, Lieberman, Pavane

[57] ABSTRACT

The present invention is a plush toy figurine (12) incorporating a motion-generating apparatus (14) activated by a sound sensing transducer (22) for shaking the figurine (12). The figurine (12) is fastened to and encased in a cage (70) having a curved base (72) such that the cage (70) rocks back and forth whenever the figurine (12) shakes. In another embodiment the figurine (12) hangs from a rod (74) whereupon the figurine swings back and forth whenever the motion generating apparatus (14) is activated. In both embodiments, shaking of the figurine (12) is accompanied by sound generated through a speaker (20) incorporated in the figurine (12).

12 Claims, 5 Drawing Sheets

SHAKING TOY

BACKGROUND OF THE INVENTION

1. Field of the Invention

This invention pertains to plush toys and more particularly to plush toys incorporating motion generating devices.

2. Background Art

Plush toys which generate motion, sound and/or light are well known. Typically, a motion, sound and/or light generating mechanism located within the plush toy is activated by touching the toy or in response to a noise generated in proximity to the toy. For example, U.S. Pat. No. 4,941,857 discloses a toy animal incorporating a vibrating mechanism activated when the toy is placed in a user's hand, the conductivity of the user's skin completing the circuit which activates the vibrating mechanism. Vibration of the toy is accompanied by an appropriate sound generated by a sound generating circuit incorporated in the toy. U.S. Pat. No. 4,571,208 discloses a plush toy monkey secured about a motion generating device which, in turn, is pivotally fixed to a member resembling a perch. In operation, as the motion generating device pivots about the perch, the toy monkey also moves. Again, such movement is accompanied by sound generated by a circuit incorporated in the toy monkey.

While these devices no doubt accomplish their intended functions, the motions generated thereby are perceived as relatively mundane. It is accordingly an object of the invention to provide a toy incorporating a motion generating device wherein the resulting motion is aesthetically creative as compared with the prior art.

It is a further object of the invention to provide a self-contained motion-generating apparatus securable in a rigid casing glued or otherwise attached to the plush toy in an interior pocket thereof, the casing being accessible via a moveable flap on the plush toy.

It is yet a further object of the invention to provide a plush toy incorporating a sound-activated motion-generating means and wherein the toy is disposed in a cage and fastened thereto, as at its extremities, the cage having a non-planar base such that when the plush toy vibrates, the cage rocks back and forth on its base.

It is still another object of the present invention to provide a plush toy incorporating a sound-activated motion-generating means and having flexible arms removably fastened to a rod such that vibration of the plush toy causes it to swing back and forth.

It is a still further object of the invention to provide plush toys of the aforementioned types with means for generating sounds appropriate to the plush toy whereby vibration of the plush toy is accompanied by sound.

SUMMARY OF THE INVENTION

The foregoing objects are achieved by the toy of the present invention which, broadly speaking, comprises in one embodiment a figurine, a vibrating mechanism incorporated in the figurine, means for activating and deactivating the vibrating mechanism, and a support structure including a non-planar base, the figurine being secured to the support structure whereby when the vibrating mechanism is activated the figurine vibrates and the support structure rocks back and forth on its base.

In a preferred embodiment the support structure is a cage-like structure having a non-planar bottom wall and the figurine is a plush toy, such as an ape, disposed in the cage-like structure and having flexible extremities secured thereto whereby the cage rocks back and forth as the plush toy vibrates. Preferably, the plush toy incorporates a sound generating means for generating a sound appropriate to the plush toy, at least when the vibrating mechanism is activated. Desirably, the vibrating mechanism and sound generating means are activated by a sound-responsive transducer incorporated in the plush toy. In the preferred embodiment the vibrating mechanism comprises a motor having an eccentric secured to its rotor, the plush toy defining a pocket having a rigid casing secured therein for receiving the vibrating mechanism, the pocket being accessible via a moveable flap on the plush toy.

In another embodiment the toy of the present invention comprises a support member, a figurine comprising at least one flexible extremity incorporating means for securing the flexible extremity to the support member, a vibrating mechanism incorporated in the figurine, and means for activating and deactivating the vibrating mechanism whereby the figurine vibrates relative to the support member when the vibrating mechanism is activated.

In a preferred version of this embodiment the figurine comprises a plush toy having at least two flexible extremities incorporating means for securing the at least two flexible extremities to the support member. In this version the portion of the support member between the extremities may be seated on an immovable object, such as a doorknob or the like.

The foregoing as well as additional details of the present invention will be more fully apparent from the following detailed description and annexed drawings of the presently preferred embodiments thereof.

DETAILED DESCRIPTION OF THE PREFERRED EMBODIMENTS

Figure 1:
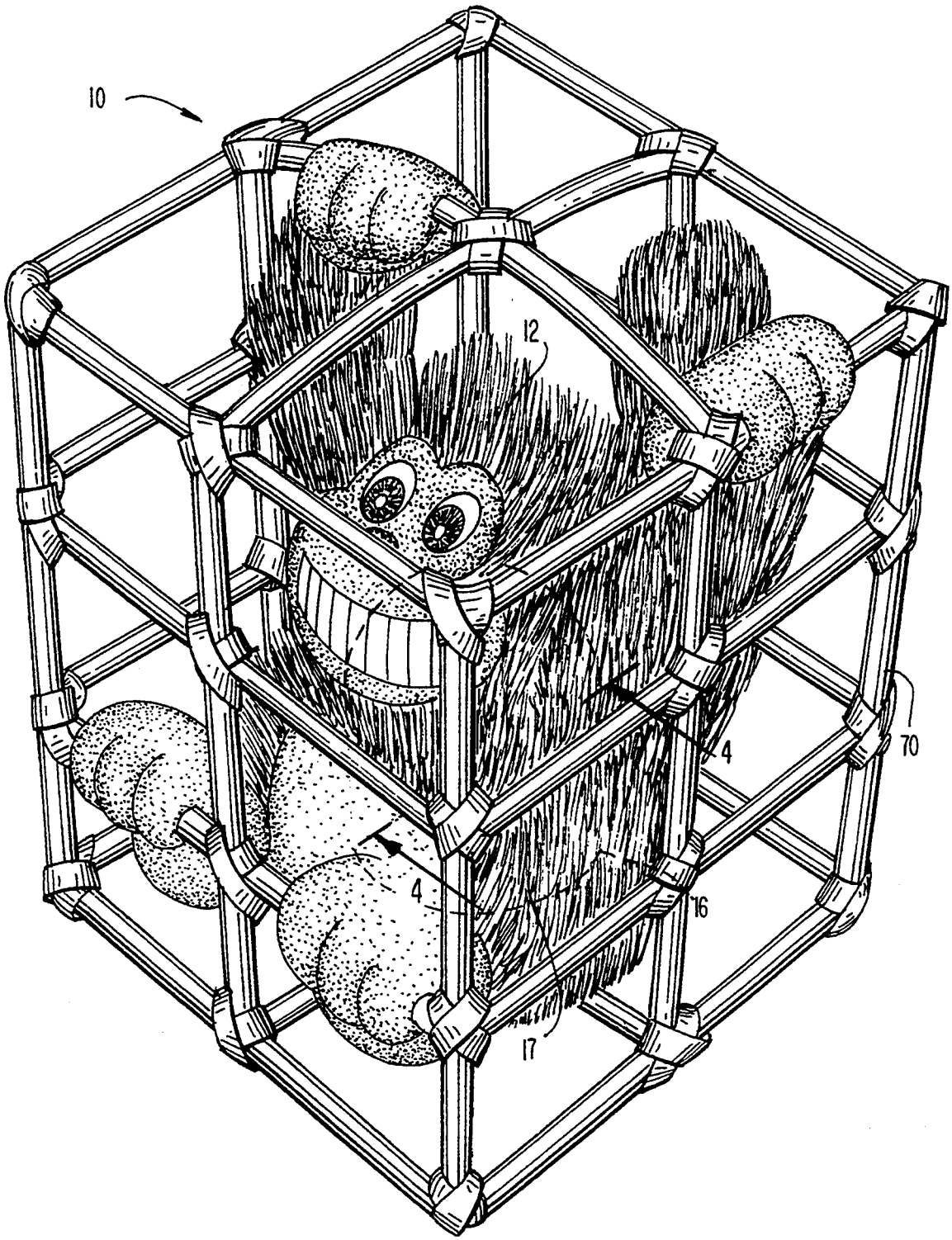
FIG. 1 is a perspective view of the preferred embodiment of the present invention.

Referring now to the drawings and initially to FIGS. 1–5, the toy in accordance with the present invention is generally designated at 10. As shown, the toy 10 comprises a plush toy figurine 12 incorporating a self-contained motion-generating apparatus 14 concealed within a rigid casing 16 glued or otherwise secured within a pocket 17 in figurine 12.

The motion-generating apparatus 14 comprises a circuit board 18 for a circuit 19 containing sound-generating electronics, a speaker 20, a transducer 22 for converting an audio signal to an electrical signal, a switch 24 and a motor 26. The motion-generating apparatus 14 also includes an integrally formed housing 28 comprising a base plate 30, a battery chamber 32 for batteries 80, two spaced circuit board mounting rails 34, two upstanding posts 36, a motor base support 38 comprising two upstanding pegs 40 positioned between posts 36, transducer mounting rails 42 and a switch support 44 for positioning the switch 24 on base plate 30. The integrally formed housing 28 also includes a speaker frame 46 for securing the speaker 20 in place. As shown, the speaker frame 46 has orifices 48 positioned over the speaker cone to facilitate the emanation of sound waves from the speaker 20. Wires, not shown, connect batteries 80, transducer 22, motor 26, speaker 20 and switch 24 to circuit 19. Housing 28 is secured to figurine 12 by screws (not shown) which extend through base plate holes 47 and into threaded cavity posts 49 in casing 16. For reasons that will be apparent, when housing 28 is secured to casing 16, orifices 48 on speaker frame 46 align with orifices (not shown) in casing 16. A flap 90 on the bottom of figurine 12 provides access to pocket 17 for inserting and removing housing 28. A piece of Velcro ® or other fastening means removably secures one side of flap 90 to the body of plush toy 12, tile other side being stitched thereto.

Figure 3:
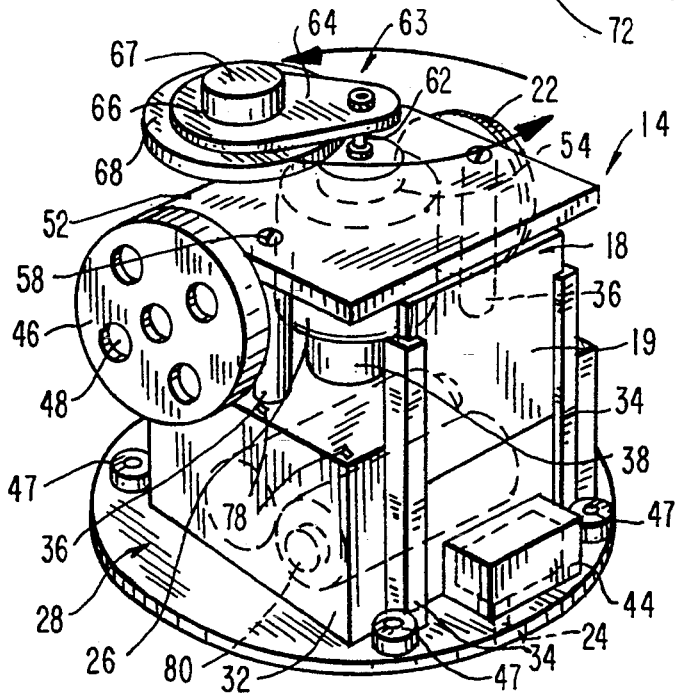
FIG. 3 is a perspective view of the motion-generating apparatus of the present invention.
Figure 4:
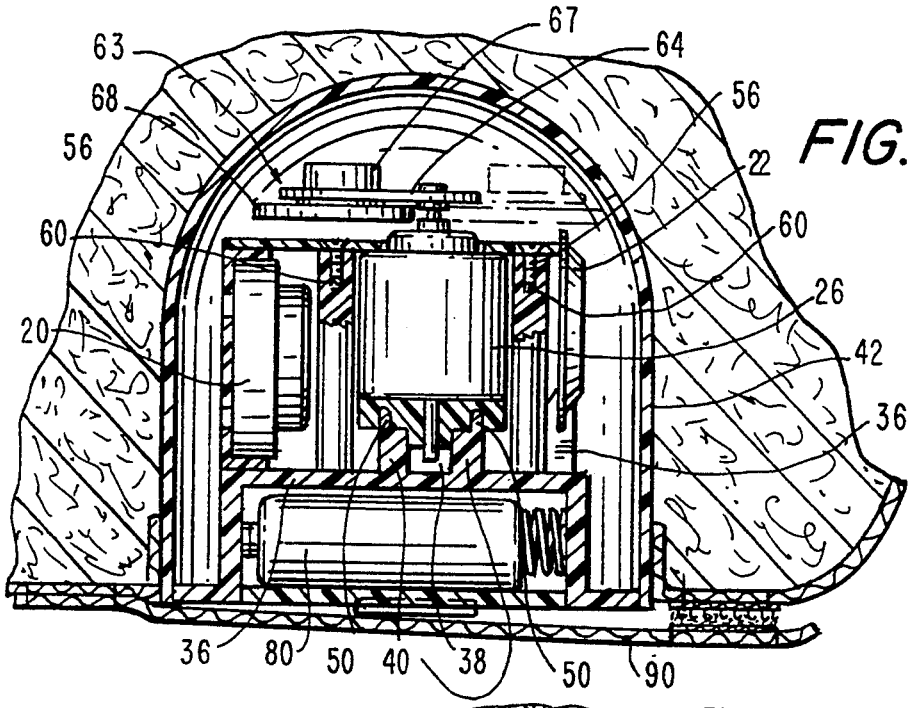
FIG. 4 is a cross-sectional view of the motion-generating apparatus of FIG. 3 taken substantially along the line 4—4 in FIG. 1.

As best seen in FIGS. 3 and 4, the circuit board 18 is secured to the housing 28 by a friction fit between the mounting rails 34. Similarly, the transducer 22 is secured to the housing 28 by a friction fit between the mounting rails 42. The base of motor 26 has two holes 50 for receiving pegs 40 thus partially securing motor 26 to housing 28. The top of motor 26 is secured to housing 28 by a motor support plate 52 having a hole 54 which snugly seats about the top of motor 20. Plate 52 is secured to housing 28 by a pair of screws 56 which pass through screw holes 58 in plate 52 and into threaded holes 60 in posts 36.

Figure 2:
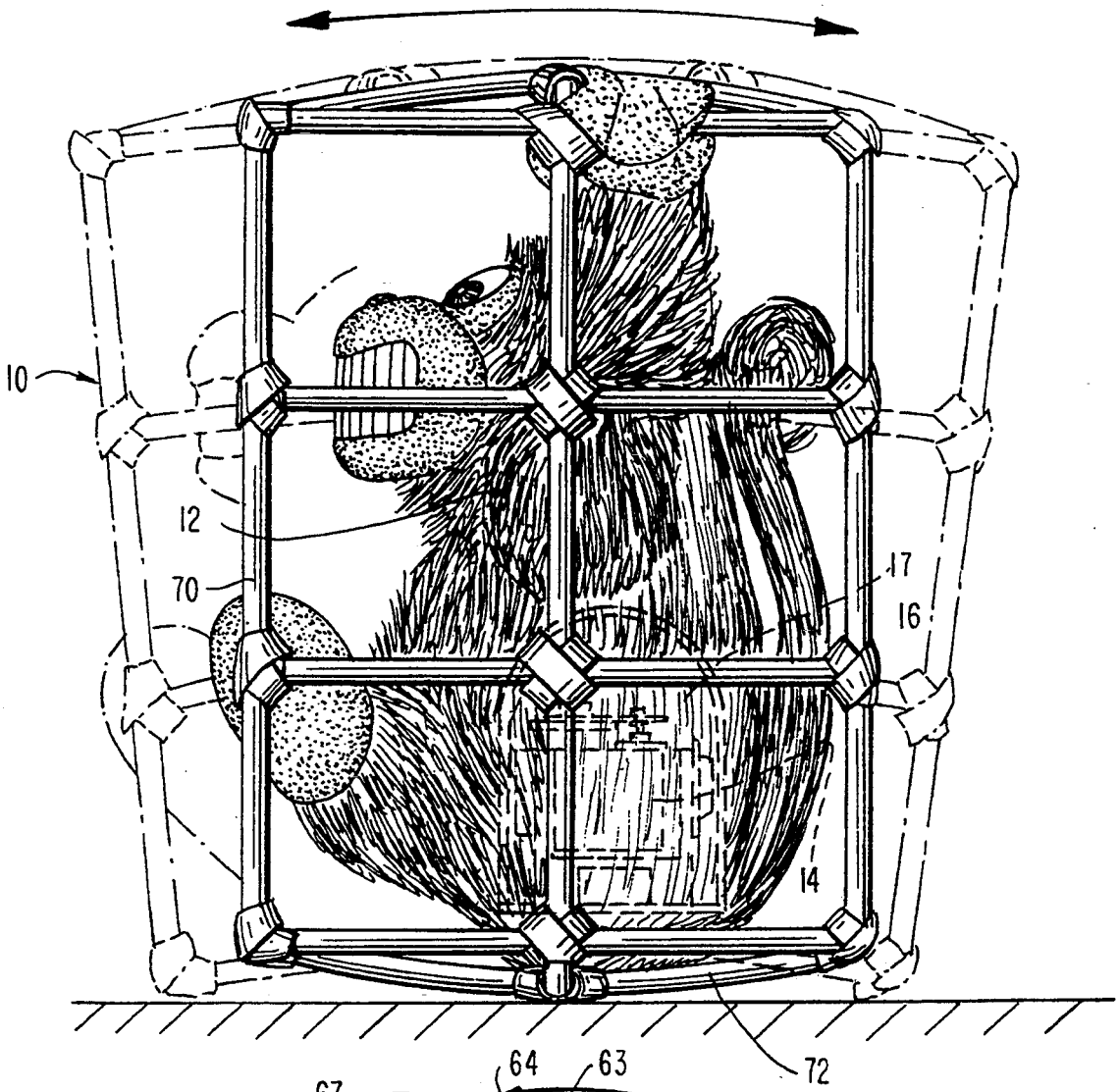
FIG. 2 is a side view thereof showing the cage, and its image in phantom, in its rocking positions.

As shown, the rotor 62 of the motor 26 extends above the support plate 52 and an eccentric 63 comprising a plate 64 and a weight 68 is attached to the free end of rotor 62. The plate 64 has a hole 66 dimensioned for a friction fit with an axial protrusion 67 on weight 68. Consequently, when the eccentric 63 rotates, a wobbling motion is imparted to housing 28 and, through the securement of base plate 30 to casing 16, this wobbling motion is transferred to the plush toy 12 thereby causing it to vibrate. As shown in FIGS. 1 and 2, the flexible arms and legs of plush toy 12 are fastened to the sides of a cage 70 having a curved base 72. In a preferred embodiment the sides of cage 70 are constructed from plastic and snap-fitted together.

The operation of the toy 10 should by now be apparent. When power switch 24 is in the "on" position, power from batteries 80 is supplied to the circuit 19. As is well known to those of ordinary skill in the art, in response to sound in a predetermined frequency range, the transducer 22 outputs an electrical signal to the circuit 19, which, in response, powers motor 26 and outputs an electrical signal corresponding to animal sounds to the speaker 20. As explained above, when motor 26 is activated, a wobbling motion is imparted to the figurine 12.

Figure 6A:
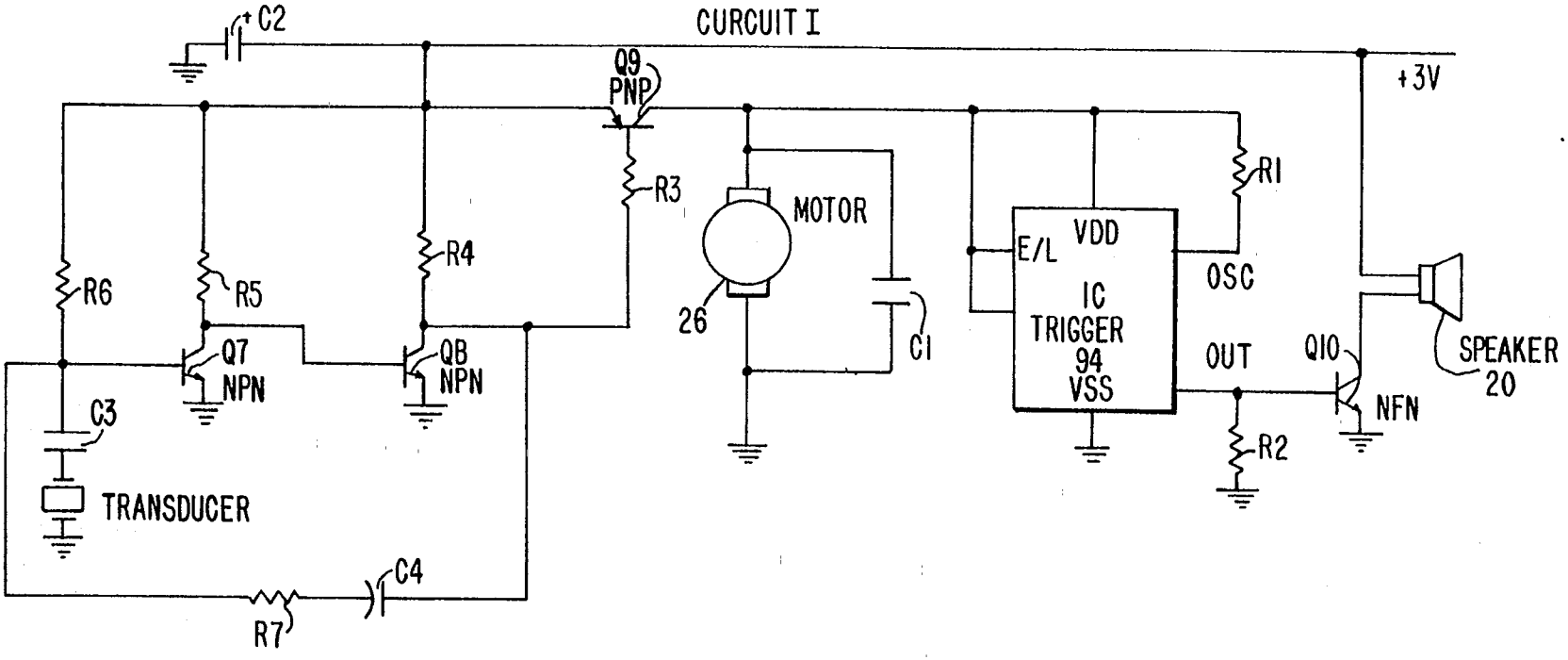
FIGS. 6A and 6B are circuit diagrams for the motion-generating apparatus of FIG. 3.
Figure 6B:
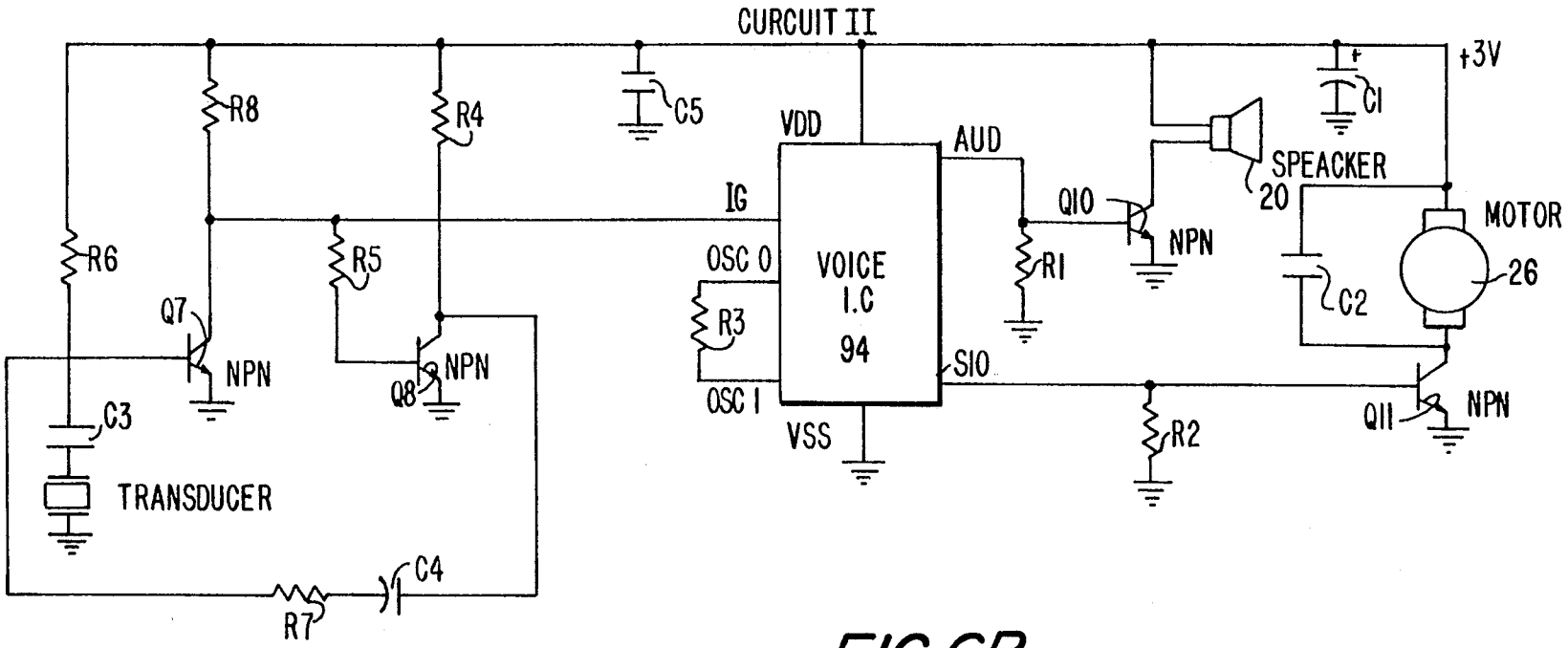

Two circuit configurations for circuit 19 are shown in FIGS. 6A and 6B. As the operation of these circuit elements will be apparent to those of ordinary skill in the art, only a brief description is given. In the circuit of FIG. 6A, the motor 26 and the sound generating electronics, depicted as an integrated circuit (IC) 94, are connected in parallel and both are connected to the batteries 80 via PNP transistor $Q_9$ configured as a switch. NPN transistors $Q_7$ and $Q_8$ are also configured as switches. In the quiescent state, the base voltage at transistor $Q_7$ is high, $Q_7$ is "on", and the collector voltage at $Q_7$ and hence the base voltage at $Q_8$ are low whereby $Q_8$ is "off". With $Q_8$ "off", the base voltage at $Q_9$ is high and $Q_9$ is "off" thus disconnecting motor 26 and IC 94 from batteries 80. Note also that in the quiescent state the voltage across $C_4$ is substantially zero. When transducer 22 is activated, as by a clapping sound, the base voltage at $Q_7$ is pulled down turning $Q_7$ "off" which turns $Q_8$ "on" as the collector voltage at $Q_7$, now high, is applied to the base of $Q_8$. When $Q_8$ is "on", the voltage at the collector of $Q_8$, and hence at the base of $Q_9$, are low, thus causing $Q_9$ to turn "on" whereupon motor 26 and the IC 94 are connected to batteries 80.

As will now be apparent, and referring to the preferred embodiment of FIGS. 1 and 2, when motor 26 is activated, the plush toy 12 begins to shake which, through its flexible extremities attached to the cage 70 as by Velcro ® or stitching, causes cage 72 to rock on its nonplanar base. Simultaneously, IC 94 applies a signal corresponding to a "screaming" ape to speaker 20 via NPN transistor $Q_{10}$. Consequently, whenever the circuit of FIG. 6A is activated as by a clapping sound detected by transducer 22, the ape-like figurine 12 begins to shake and "scream" and the cage 70 begins to rock on its non-planar base. The resulting effect is of an enraged ape shaking its cage in an effort to escape.

$Q_9$ remains "on" applying power to motor 26 and IC 94 until $Q_8$ turns "off". The duration that $Q_8$ is on is controlled by circuit elements $C_4$, $R_3$, $R_4$, $R_5$, $R_6$ and $R_7$, i.e. the parallel resistor combination of $R_3$, $R_4$ and $R_5$ in series with $R_6$, $R_7$ and $C_4$. In particular, when transducer 22 is activated and $Q_7$ turned "off", a step voltage is applied across $C_4$ from the collector of $Q_8$. As is known to those of ordinary skill in the art, the voltage at $C_4$ exponentially decays through the resistor combination stated above. As long as the voltage at the base of $Q_7$ remains below threshold, $Q_7$ stays "off" and motor 26 and IC 94 are powered as more fully explained above. However, when the voltage across $C_4$ decays sufficiently that the voltage at the base of $Q_7$ rises above threshold, $Q_7$ turns "on", $Q_8$ and $Q_9$ turn "off" and motor 26 and IC 94 are disconnected from batteries 80 as more fully explained above whereupon the plush toy 12 ceases to shake and "scream".

FIG. 6B is an alternative circuit to FIG. 6A. As in several respects the circuit of FIG. 6B is similar to that of FIG. 6A, only the differences will be described. In FIG. 6B, $Q_9$ is eliminated and the activating signal for IC 94 comprises the collector voltage at $Q_7$. As will be apparent from the description of the circuit of FIG. 6B, the collector voltage at $Q_7$ is only high for activating IC 94 when $Q_7$ is "off" after activation of transducer 22 as by a clapping sound. The other primary difference between the circuits of FIGS. 6A and 6B is that in FIG. 6B motor 26 is activated by IC 94 acting through NPN transistor $Q_{11}$, motor 26 being activated whenever IC 94 drives the base voltage at $Q_{11}$ high. This arrangement has the advantage that activation of motor 26 can be controlled in any desired fashion by suitably programming IC 94.

Suitable values for the circuit components in FIG. 6A are:

| | |
|---|---|
| $R_1$ = 180K | $R_2$ = 0.22K |

-continued

| | |
|---|---|
| $R_3 = 0.1K$ | $R_4 = 1.0K$ |
| $R_5 = 22K$ | $R_6 = 3.9M$ |
| $R_7 = 5.6K$ | |
| $C_1 = 100$ mf | $C_2 = 0.1$ mf |
| $C_3 = 0.0047$ mf | $C_4 = 0.47$ mf |

Suitable values for the circuit components in FIG. 6B are:

| | |
|---|---|
| $R_1 = 180K$ | $R_2 = 0.22K$ |
| $R_3 = 82K$ | $R_4 = 1.0K$ |
| $R_5 = 22K$ | $R_6 = 3.9K$ |
| $R_7 = 5.6K$ | $R_8 = 0.1K$ |
| $C_1 = 100$ mf | $C_2 = 0.1$ mf |
| $C_3 = 0.0047$ mf | $C_4 = 0.47$ mf |
| $C_5 = 0.0022$ mf | |

For both circuits, suitable values for the remaining components will be readily apparent to those of ordinary skill in the art.

Figure 5:
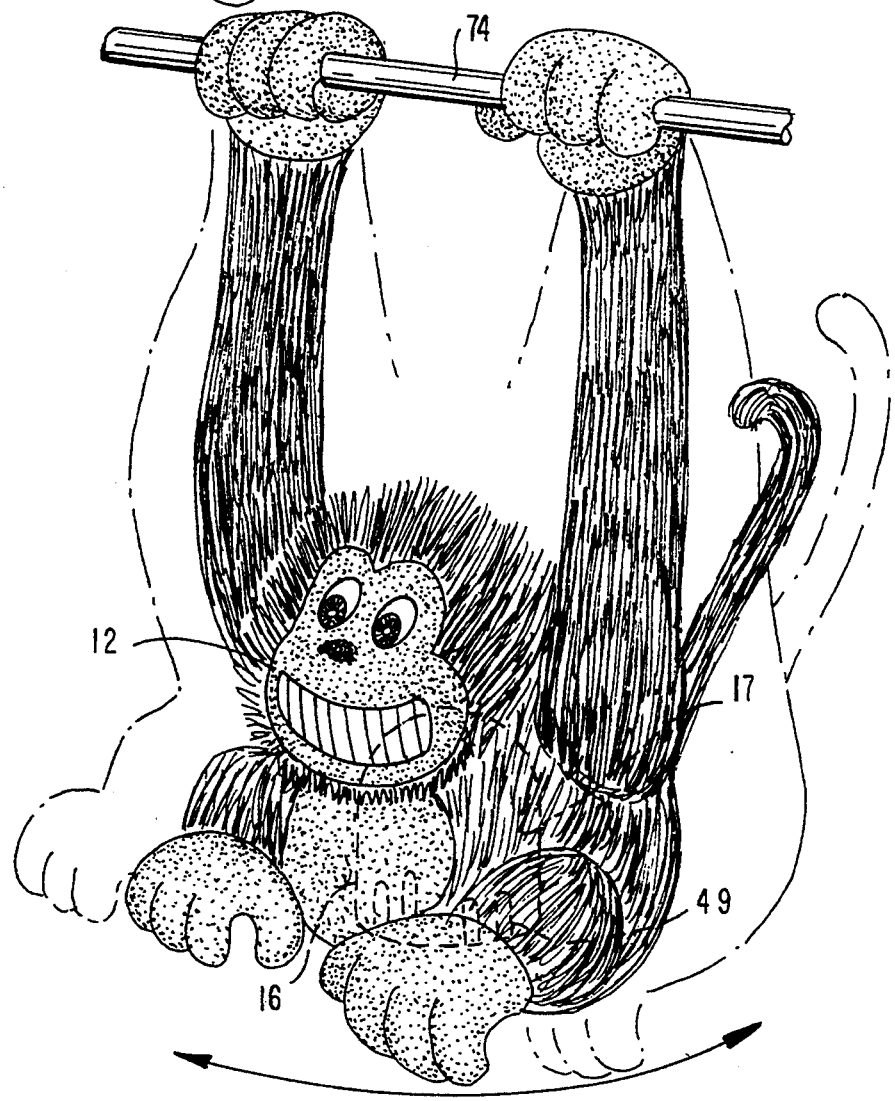
FIG. 5 is a perspective view of another embodiment of the present invention.

Another preferred embodiment of the present invention is shown in FIG. 5. In FIG. 5, a plush toy monkey 12 incorporating the self-contained motion-generating apparatus 14 has its flexible arms fastened to a support member or rod 74 which, in turn, is supported by a support means such as a relatively immovable object like, for example a door knob or ceiling hook 75. As should by now be apparent, when the motion generating apparatus 14 is activated, the monkey 12 shakes because its arms are fixed to rod 74, which causes monkey 12 to swing back and forth relative to rod 74. Simultaneously, the monkey 12 "screams" through speaker 20 as more fully explained above.

Although I have herein shown and described the preferred embodiments of the invention, various changes and modifications will be readily apparent to those of ordinary skill in the art who read the foregoing description. For example, instead of a sound activated switch 22, a switch sensitive to other environmental changes, such as temperature or light, may be used to activate the device. Likewise, the figurine 12 may be other than a monkey or ape and the sound generated through speaker 20 modified accordingly. As these as well as further changes and modifications are intended to be within the scope of the present invention, the foregoing description should be construed as illustrative, and not in a limiting sense, the scope of the invention being defined by the following claims.

I claim:

1. A toy comprising:

a support member comprising a cage-like structure having a non-planar bottom surface;

a figurine dispose within said cage-like structure, said figurine having at least one flexible extremity incorporating means for securing said flexible extremity to said structure;

a vibrating mechanism incorporated in said figurine for vibrating said figurine; and means for activating and deactivating said vibrating mechanism, said figurine vibrating when said vibrating mechanism is activated and, via said at least one flexible extremity, rocking said cage on said non-planar bottom surface, said at least one flexible extremity further effecting relative movement between said figurine and said structure.

2. The toy of claim 1, wherein said means for activating and deactivating said vibrating mechanism comprises a sound responsive transducer connected to said vibrating mechanism for activating said vibrating mechanism in response to an external sound.

3. The toy of claim 1, wherein said figurine includes an internal pocket, further comprising a rigid casing secured in said pocket, and wherein said vibrating mechanism is secured in said casing.

4. The toy of claim 1, further comprising means for generating sound at least when said vibrating mechanism is activated.

5. The toy of claim 1, wherein said vibrating mechanism comprises a motor having a rotor and an eccentric secured to said rotor for rotation therewith.

6. The toy of claim 1, wherein said at least one flexible extremity further comprises four flexible extremities resembling arms and legs which are secured to said cage-like structure for creating the appearance of said figurine shaking said structure in a violent manner when said vibrating mechanisms is activated.

7. The toy of claim 6, wherein said means for activating and deactivating said vibrating mechanism comprises a sound responsive transducer connected to said vibrating mechanism for activating said vibrating mechanism in response to an external sound.

8. The toy of claim 7, wherein said figurine includes an internal pocket, further comprising a rigid casing secured in said pocket, and wherein said vibrating mechanism is secured in said casing.

9. The toy of claim 8, wherein said figurine further comprises a moveable flap for accessing said pocket.

10. The toy of claim 9, further comprising means for generating sound at least when said vibrating mechanism is activated.

11. The toy of claim 10, wherein said vibrating mechanism comprises a motor having a rotor and an eccentric secured to said rotor for rotation therewith.

12. The toy of claim 1, wherein said figure comprises a plush gorilla.

* * * * *